US010995430B2

(12) United States Patent
Makkar

(10) Patent No.: US 10,995,430 B2
(45) Date of Patent: May 4, 2021

(54) YARN MANUFACTURING

(71) Applicant: Amrapur Overseas, Inc., Corona, CA (US)

(72) Inventor: Vikas Makkar, Village Kuranwala (IN)

(73) Assignee: Amrapur Overseas, Inc., Corona, CA (US)

( * ) Notice: Subject to any disclaimer, the term of this patent is extended or adjusted under 35 U.S.C. 154(b) by 0 days.

(21) Appl. No.: 16/368,264

(22) Filed: Mar. 28, 2019

(65) Prior Publication Data

US 2020/0157710 A1 May 21, 2020

Related U.S. Application Data

(63) Continuation-in-part of application No. 16/289,543, filed on Feb. 28, 2019, now abandoned.

(30) Foreign Application Priority Data

Nov. 20, 2018 (IN) ..... 201841043600

(51) Int. Cl.
*D02G 3/28* (2006.01)
*D02G 1/02* (2006.01)

(52) U.S. Cl.
CPC ..... *D02G 3/286* (2013.01); *D02G 1/02* (2013.01); *D10B 2401/02* (2013.01); *D10B 2503/00* (2013.01)

(58) Field of Classification Search
CPC ..... D02G 1/024; D02G 3/286; D01H 1/11; D01H 1/115; D01H 4/02
See application file for complete search history.

(56) References Cited

U.S. PATENT DOCUMENTS 3,306,023 A * 2/1967 Henshaw et al. ..... D02G 3/286 57/293
3,717,988 A * 2/1973 Walls ..... D02G 3/286 57/293
4,103,481 A * 8/1978 Vukoje ..... D02G 1/024 57/205
4,112,658 A * 9/1978 Morihashi ..... D02G 1/04 57/328
4,170,103 A * 10/1979 Norris ..... D02G 1/024 57/22
4,183,202 A * 1/1980 Morihashi ..... D01H 1/115 57/328
4,279,120 A * 7/1981 Norris ..... D02G 3/286 57/204

(Continued)

OTHER PUBLICATIONS

Shaun R Hurley, "Non-Final Office Action", dated Apr. 21, 2020, U.S. Appl. No. 16/289,543.

*Primary Examiner* — Shaun R Hurley
(74) *Attorney, Agent, or Firm* — LeonardPatel PC; Sheetal S. Patel; Michael A. Leonard, II

(57) ABSTRACT

A process for manufacturing a yarn includes twisting the yarn in a first direction for a predefined number of twists. The method also includes, after the predefined number of twists, twisting the yarn in a second direction for a predefined number of twists, the predefined number of twists for the second yarn is same as the predefined number of twists for the first yarn. The twisting of the yarn in the second direction creates an air bed within the yarn's fibers.

6 Claims, 6 Drawing Sheets

(56) References Cited

U.S. PATENT DOCUMENTS 4,345,425 A * 8/1982 Negishi ..... D02G 1/024 28/220
4,346,552 A * 8/1982 Negishi ..... D02G 1/024 57/208
4,387,487 A * 6/1983 Nakahara ..... D01H 5/26 19/249
4,402,178 A * 9/1983 Negishi ..... D02G 1/024 57/205
4,497,167 A * 2/1985 Nakahara ..... D01H 1/115 57/328
4,524,580 A * 6/1985 Fehrer ..... D01H 1/11 57/328
5,003,763 A * 4/1991 Hallam ..... D02G 3/286 57/22
5,012,636 A * 5/1991 Hallam ..... D02G 3/286 57/204
5,179,827 A * 1/1993 Tinsley ..... D02G 3/286 57/204
5,228,282 A * 7/1993 Tinsley ..... D02G 3/286 57/293
5,481,863 A * 1/1996 Ota ..... D01H 1/115 57/315
5,557,915 A * 9/1996 Knoff ..... D02G 3/286 57/204
7,581,376 B2 * 9/2009 Simmonds ..... D02G 1/161 57/333
2002/0026781 A1 * 3/2002 Shigeyama ..... D01H 4/02 57/12
2003/0177751 A1 * 9/2003 Stalder ..... D01H 4/02 57/403
2004/0016223 A1 * 1/2004 Stalder ..... D01H 1/115 57/400
2010/0024376 A1 * 2/2010 Tao ..... D01H 7/923 57/333
2011/0146832 A1 * 6/2011 Hsu ..... D02G 3/367 139/420 R
2012/0151894 A1 * 6/2012 Tao ..... D01H 13/08 57/75

* cited by examiner

YARN MANUFACTURING

CROSS-REFERENCE TO RELATED APPLICATION

This application is a continuation-in-part (CIP) and claims priority to, and the benefit of, U.S. Non-Provisional application Ser. No. 16/289,543, filed on Feb. 28, 2019, which claims priority to, and the benefit of, Indian Patent Application No. 201841043600, filed on Nov. 20, 2018. The subject matter thereof is hereby incorporated herein by reference in its entirety.

FIELD

The present invention relates to manufacturing yarn, and more particularly, to a process for manufacturing yarn.

BACKGROUND

With conventional yarn manufacturing, yarn 100 undergoes either a "S" twist 102 or a "Z" twist 104. See, for example, FIG. 1. For example, the difference between the two is the direction in which the fibers are twisted as the thread is spun: S twist is to the right and Z twist is to the left.

SUMMARY

Certain embodiments of the present invention may provide solutions to the problems and needs in the art that have not yet been fully identified, appreciated, or solved by current yarn manufacturing techniques. For example, some embodiments generally pertain to a process for manufacturing yarn using both a "S" twist and "Z" twist, one-by-one under a controlled environment.

In an embodiment, a process for manufacturing a yarn includes twisting a plurality of fibers in a first direction. The process also includes twisting the plurality of fibers in the second direction. The change of twisting from the first direction to the second direction or vice versa creates an air gap between the plurality of fibers. The air gap is configured to provide the effect of a thicker yarn upon completion of manufacturing.

In another embodiment, a process for manufacturing a yarn includes twisting the yarn in a first direction for a predefined number of twists or for a predefined period of time. The process also includes twisting the yarn in a second direction for a predefined number of twists or for a predefined number of time. The predefined number of twists and the predefined number of time for the second yarn is same as the predefined number of twists or the predefined number of time for the first yarn. The twisting of the yarn in the second direction creates an air bed within the yarn's fibers.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments generally pertain to manufacturing yarn. In an embodiment, the yarn is processed with both "S" and "Z" twists, one-by-one simultaneously under a controlled environment. Controlled environment may refer to the spindle speed at which the twisting is performed, for example. In some embodiments, the twisting is performed at a rate of 1,200 to 12,500 RPM. This creates an air bed between the fibers. The air bed essentially expands the yarn to form an airy and bulkier yarn.

Figure 1:
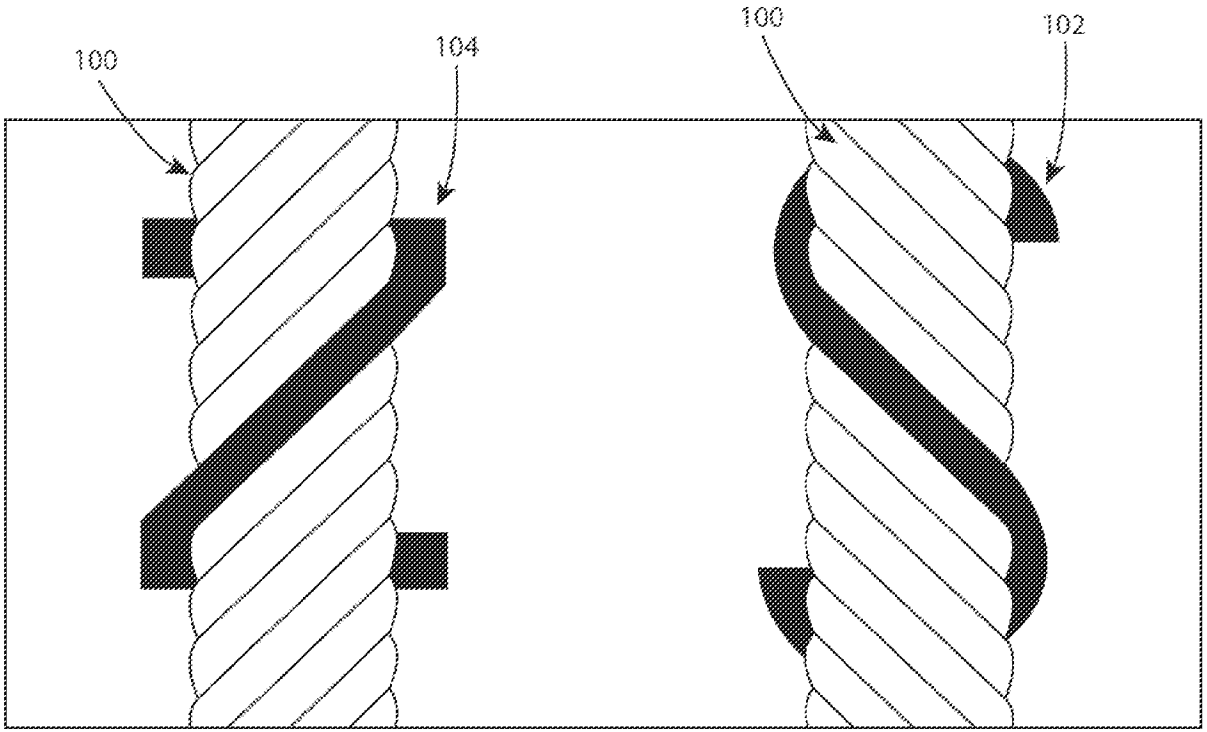
Fig. 1 Related Art
FIG. 1 is a diagram illustrating a yarn undergoing a "S" twist and a "Z" twist, according to an embodiment of the present invention.
Figure 2:
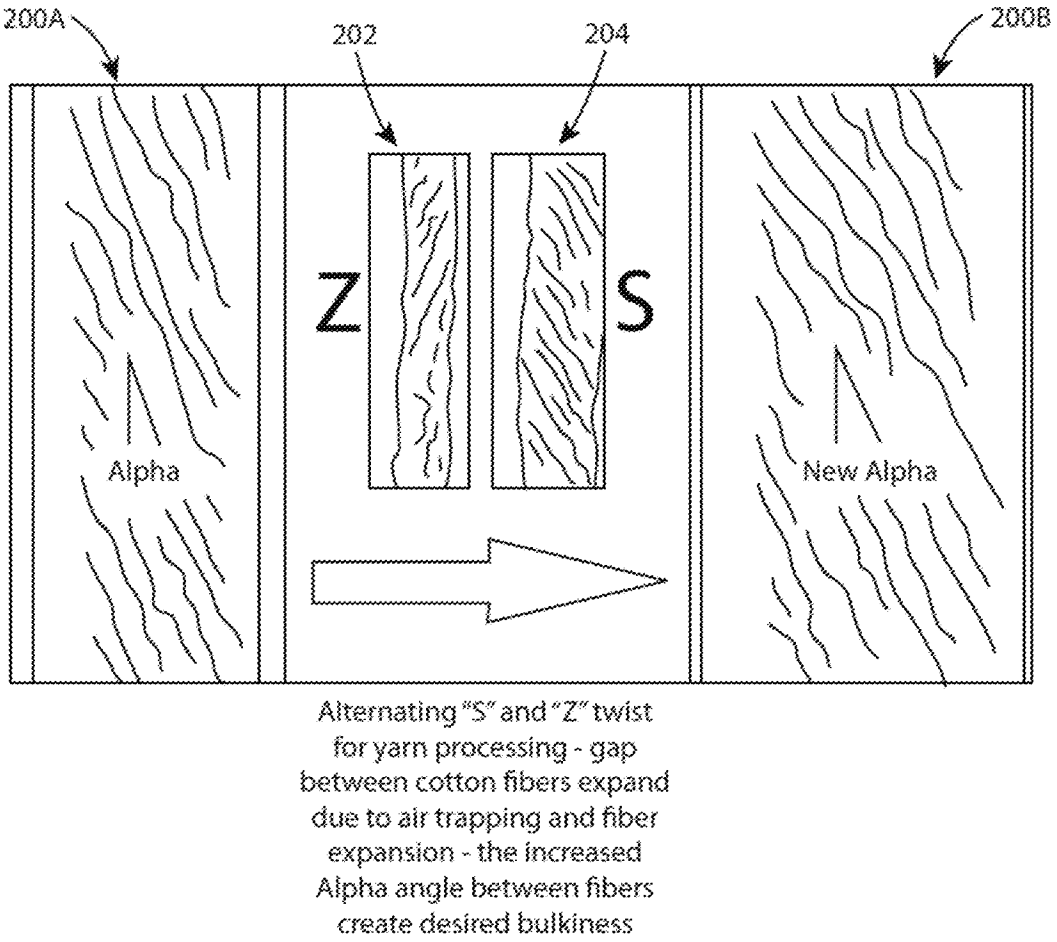
FIG. 2 is a diagram illustrating a yarn having an alpha angle and a manufactured yarn having a new alpha angle, according to an embodiment of the present invention.

FIG. 2 is a diagram illustrating a yarn 200A having an alpha angle and a manufactured yarn 200B having a new alpha angle, according to an embodiment of the present invention. A yarn may be composed of a plurality of fibers. In an embodiment, yarn 200 may have an alpha angle. It should be noted that the unit for twist is different in the above expressions of the twist factor. Furthermore, the twist factor may be known as twist multiplier, twist alpha, or twist coefficient.

Angle of Twist (Alpha)

In an embodiment, the yarn twist angle is the angle between a tangent to the helix formed by a fiber on the yarn surface and the yarn axis. If the twist multiplier of a cotton yarn is known, the twist angle can be easily calculated.

Factors Affecting Twist

The twist introduced in the yarn during spinning may depend upon several factors. These factors include, but are not limited to, the count of the yarn to be spun, the quality of the cotton, the fineness of the fiber being spun, and the softness of the fabric into which the yarn is to be converted.

During the manufacturing process, yarn 200A undergoes alternating "S" and "Z" twists or by inducing a false twist. Let's say for example the yarn is initially spun in a "S" direction 204 and then subsequently spun in a "Z" direction 202. A false twist may be induced when the yarn is spun in the original "S" direction, giving the impression that the yarn is continuously spun in the same direction. This alternating "S" and "Z" twist traps air within (or between) the fiber (e.g., cotton fiber). The trapped air creates a gap between the fiber, resulting in the expansion of the fiber (see yarn 200B).

With this two-for-one or false twisting process (e.g., the alternating "S" and "Z" twists), yarn 200B is free from imperfections as the internal parallel fibers are held by wrapper fibers (both of the same staple length cotton). For example, yarn imperfections are generally measured using an imperfection index (IPI). For a basic ring spun yarn, the IPI has a carded quality yarn of less than equal to (≤) 200 and a combed quality of less than equal to (≤) 20. With the two-for-one process, the IPI is approximately 7 in certain embodiments. In other words, this alternating "S" and "Z" twist through false twist gives a higher level of consistency and a better end product from all prospects—bulk, feel, and aesthetics.

Figure 3:
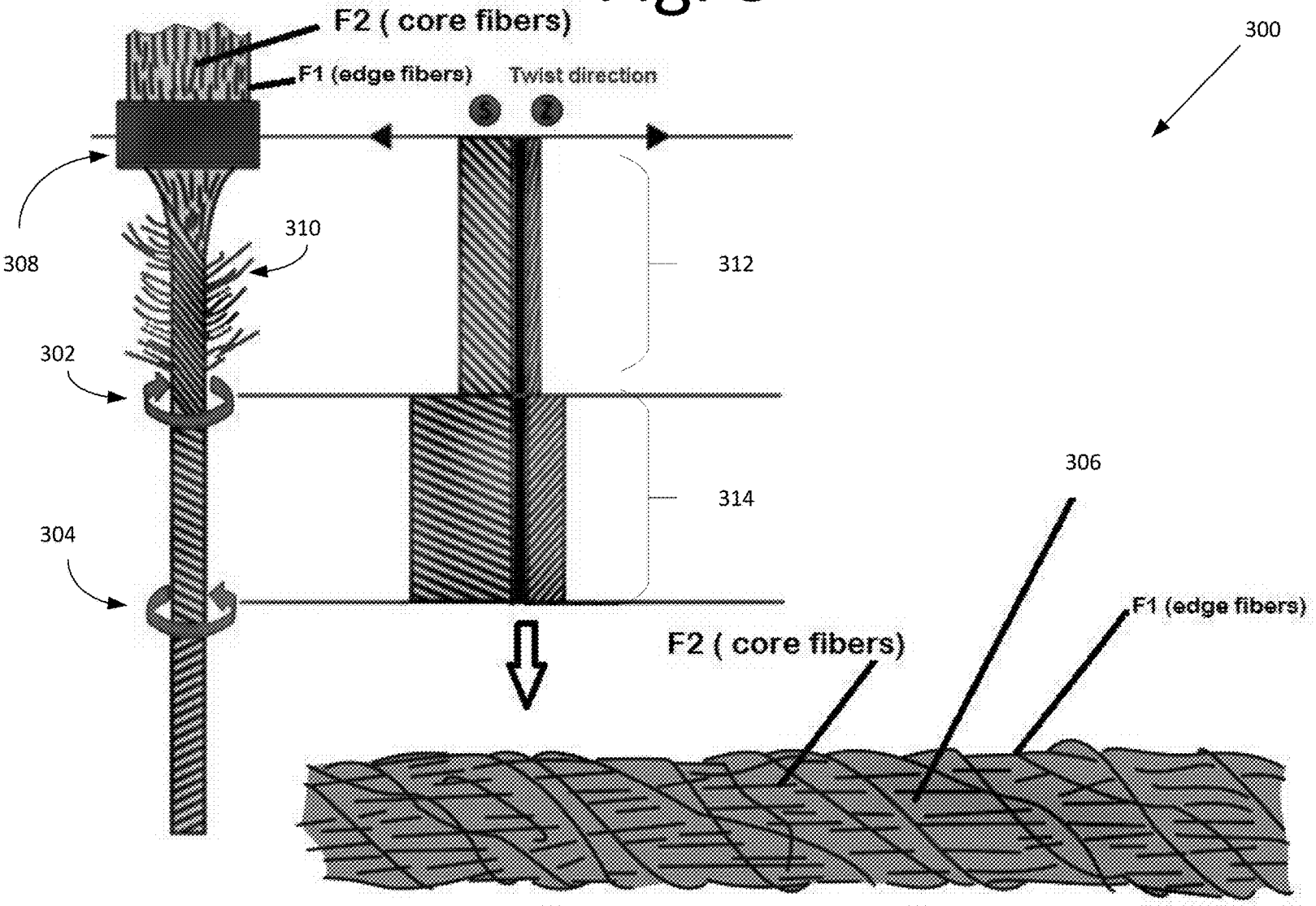
FIG. 3 is a diagram illustrating a yarn, according to an embodiment of the present invention.

FIG. 3 is a diagram illustrating a yarn 300, according to an embodiment of the present invention. In an embodiment, a yarn may be composed of a plurality of fibers. For example, in FIG. 3, yarn 300 is composed of two fibers types of fibers—fiber F1 and fiber F2. Fiber F1 are fibers that are within (or inside the external surface of) yarn 300. These fibers are known as core fibers. Fiber F2 are fibers that are on the external surface of yarn 300. These fibers are known as edge fibers, and F2, which are edge fibers.

Figure 5:
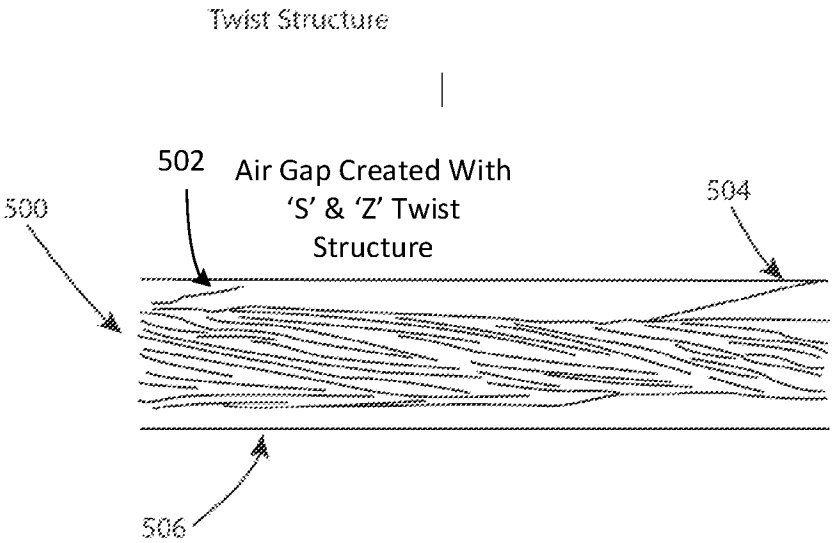
FIG. 5, which is a diagram of a yarn with an air gap created by the change in twist direction, according to an embodiment of the present invention.

As shown in FIG. 3, fibers F1, F2 are twisted in a "S" twist 302, e.g., fibers F1 and F2 are twisted in a first direction, and subsequently twisted in a "Z" twist 304, e.g., fibers F1 and F2 are twisted in a second direction. With the introduction of the false twist by block 308, the direction of "S" and "Z" appears simultaneously on fibers F1, F2 and the distribution of the twist in the running fiber strands produces an air gap 306. See FIG. 5, which is a diagram of a yarn 500 with an air gap 502 created by the change in twist direction, according to an embodiment of the present invention. The twisting techniques may create air gaps. In other words, the air gaps may be referred to as the micro distance created between the fibers as shown in—items 504 and 506 of FIG. 5.

Returning to FIG. 3, fibers F2 on the external surface of yarn may appear in strand form 310. These strands 310 are loosely binded yarns, in some embodiments, and are removed during the combing process. Item 312 demonstrates that the "S" and "Z" twist directions, and by way of the twisting, item 314 demonstrates the expansion of the yarn.

Below is a general guideline for manufacturing the yarn.

Blow Room

In an embodiment, blow room is the initial stage in the spinning process. The name blow room is given because of "air flow" and all processes are performed in the blow room because of the air flow.

Blow room may include different machines to carry out the objectives therein. In blow room, the tuft size of cotton becomes smaller and smaller. Put simply, a section in which the supplied compressed bales are opened, cleaned and blended or mixed to form uniform lap of specific length. This may be referred to as blow room section. It should be appreciated that during the opening, cleaning, blending, or mixing, different faults or defects may occur in the blow room. Also, in the blow room, normally 40-70 percent trash is removed.

Carding

Carding is a mechanical process that disentangles, cleans and intermixes fibers to produce a continuous web or sliver suitable for subsequent processing. In this process, fibers are opened and parallelized to remove dust, impurities, and short fibers. This produces a continuous strand of sliver. This is achieved by passing the fibers between differentially moving surfaces covered with card clothing, for example.

Unilap

In an embodiment, prior to combing, a lap of desired fineness, length, weight, and fiber orientation is fed to the comber for an effective combing process.

Drawframe

In an embodiment, drawframe machine for spinning is used to transform the sliver from the carding into a drawn sliver in cotton spinning mill. The drawframe improves the uniformity of the fibers by drafting and doubling and straightens the crimped, curled and hooked fibers. The operation of drawframe is blended, doubled and leveled.

Combing

A comber machine may comb the fiber. It should be noted that the straightening and parallelization of fibers and the removal of short fibers and impurities may be accomplished by using combs, knives, brushes and rollers.

Drawframe

After combing, the fiber may be spun through the drawframe machine again. A detailed explanation of the drawframe machine is explained above.

Spedframe

With the spedframe, the draw sliver is attenuated to a suitable size for spinning by inserting a small amount of twist for strengthening the roving and by winding the twisted strand roving into a bobbin.

Ringframe

This process further drawings out roving to the final yarn count needed. For example, a twist is inserted into to the fibers by way of a rotating spindle and winding the yarn on a bobbin. A stationary ring is around the spindle, which holds the traveler.

Autoconer

The autoconer machine is used in the winding process to obtain a high quality yarn with low man power. For example, threads are spliced automatically. That is, the threads are opened at the broken ends and the ends are retwisted after the removal of faults.

After autoconing, the yarn is put on a two-for-one twisting machine, and the yarn undergoes a simultaneous "S" and "Z" twist, resulting in an "air-bed" layered yarn.

Figure 4:
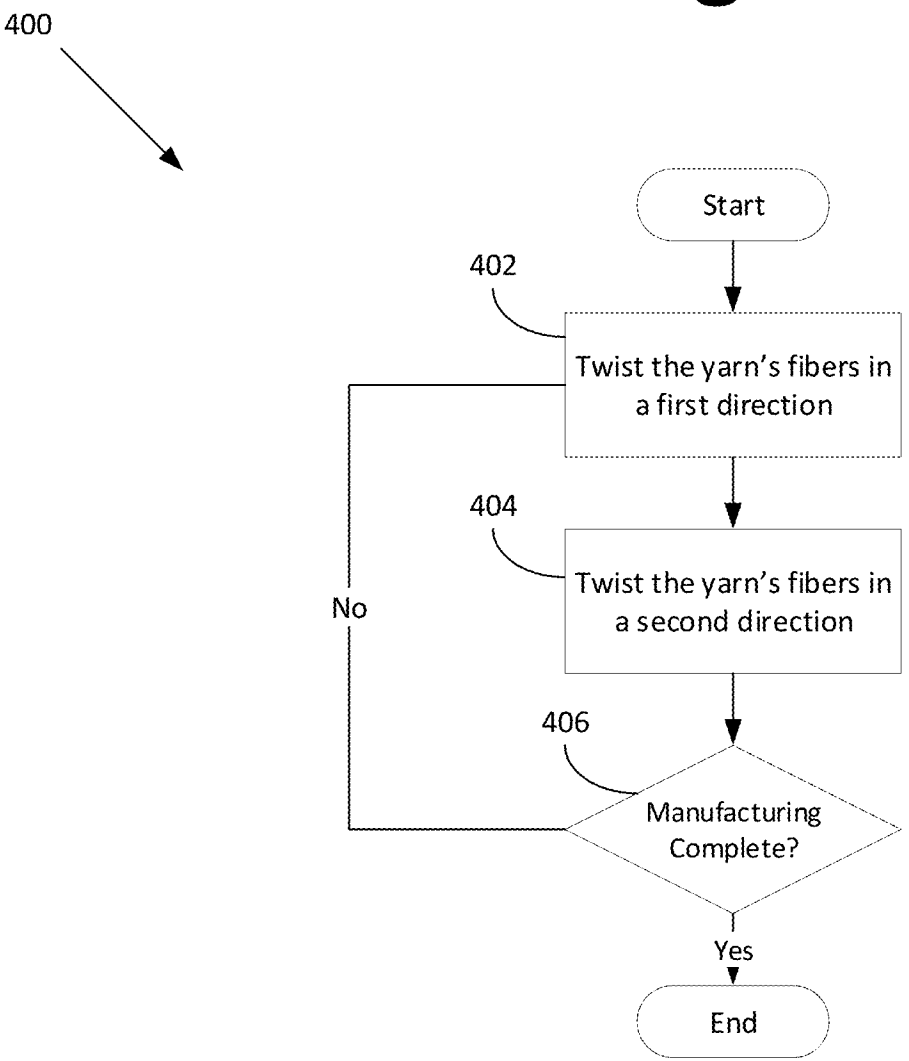
FIG. 4 is a flow diagram illustrating a process for manufacturing the yarn, according to an embodiment of the present invention.

FIG. 4 is a flow diagram illustrating a process 400 for manufacturing the yarn, according to an embodiment of the present invention. In an embodiment, process 400 may begin at 402 with twisting the yarn's fibers in a 'S' or 'Z' direction; otherwise known as a first direction. In an embodiment, the twisting of the fibers in the first direction may be for a predefined number of twists. In other embodiments, however, twisting in either direction is simultaneous and is based on time and speed. A formula that may be used to calculate the twist per meter (TPM) is=Spindle Speed/Delivery Speed, e.g., rotations per minute (RPM) divided by meters per minute.

At 404, the yarn's fibers are twisted in a second (or opposite) direction. The second direction may be either a 'Z' or 'S' direction, essentially being in the opposite direction to that of the first direction. The number of twists, or the timing of the twists, in the second direction may be the same as the first direction. By introducing false twist, an "air-bed" layered yarn is developed.

At 406, if the manufacturing of the yarn is complete, then process 400 is completed; otherwise, process 400 returns to step 402. Once the desired count of yarn is achieved, i.e., yarn mass or liner mass density which is measured in Tex—English yarn count system, the yarn mass or linear mass is calculated by below formula $$n_F = \frac{tex_{yarn}}{tex_{fiber}}$$

to give $$tex_{yarn} = n_F \times tex_{fiber}$$

where $n_F$ is the number of fibers.

Is should be noted that the number of fibers depends on yarn type. In certain embodiments, for some types of yarns, 30 to 33 fibers are twisted.

In some embodiments, the process is carried out on coarse counts, e.g., yarns that have counts 13's and below. The primary use of this yarn may be in products that use coarse counts, such as terry towels, rugs, and bathmats. As discussed, the yarn is bulkier than other conventional yarns, which have been made using the same yarn count. For example, a 550 GSM towel made of 9's carded ring spun yarn would be at least 15 percent to 20 percent less bulky than towels made under the embodiments described herein.

The absorbency of the product made using the process described herein is reasonably higher than the conventional yarn towels. The quality of towels made from this yarn can be referred or compared to Zero-Twist towels. However, the advantages of the towels in some of these embodiments are that the yarn is processed without using any PVA (Poly Vinyl Alcohol), which is a threat to the environment. Another advantage is that towels made of this yarn are quite low on lint.

In the above described process, where a twist in a first direction results in the yarn being Z twisted then the twist in the second direction is in an S direction and effectively untwisting the yarn. In some embodiments, the amount of twist and untwist, or counter twist remains balanced to ensure that torque created by Z twisting and remaining in the yarn is balanced by torque created by S twisting to for a balanced yarn. It follows, that the degree of the first and second twisting, and the respective directions of same, will vary according to the nature of yarn to be twisted but in any event will produce a balanced yarn. Fabrics produced from yarns treated as per the above method typically exhibit no, or at least very little, spirality before and after processing—which results in soft and bulky, as well as a smoother fabric.

Figure 6B:
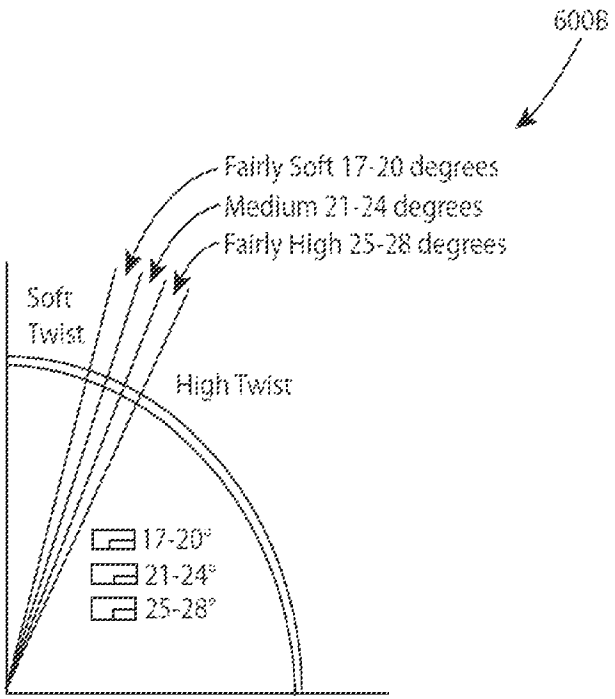
FIGS. 6A and 6B are charts illustrating a comparison of twisted yarn fibers and angles, according to an embodiment of the present invention.
Figure 6A:
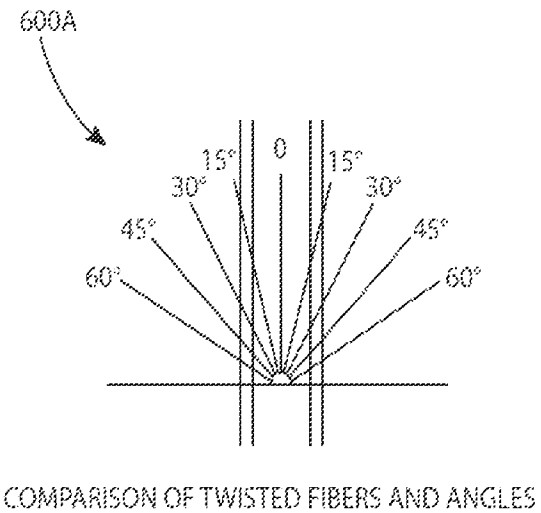

FIGS. 6A and 6B are charts 600A and 600B illustrating a comparison of twisted yarn fibers and angles, according to an embodiment of the present invention. The angle between consecutive fibers in a spun yarn is directly proportional to the structure and tightness of the yarn and inversely proportional to the softness and airiness of the resultant yarn. Simply put, charts 600A and 600B show the fiber extensions in a yarn, which can otherwise only be measured with great difficulty. Such a scale could, however, probably be provided by an angle, for example, the angle γ of inclination to the axis. Greater the angle lesser is the strength and higher is the softness and bulk and Vice Versa.

Unlike the conventional method used for yarn spinning, which is to either undergo a S or Z twist, with some of the embodiments described herein the twisting direction of the yarn affects the final properties of the fabric. Further, the combined use of the two twist directions nullifies skewing in final fabric making the fabric not only fluffier and softer, but also bulkier. This is primarily due to the "airy beds" as referred or reduction of "spirality effect" created between the fibers.

Also, in some embodiments, the yarn is free of distorting forces, achieving a permanent twist setting. This also results in the woven fabric being free of spirality. Further, the yarn, and consequently, the woven fabric is bulkier, fuller, and has a better handle than that given by a twistless yarn.

It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A process for manufacturing a single yarn, comprising:

twisting a single strand of staple fibers in a first direction; and twisting the single strand of staple fibers in a second direction, wherein a change of twisting from the first direction to the second direction or vice versa inducing a false twist so that staple fibers are viewed in a single twist direction, the change of twisting traps air within or between the staple fibers in the single yarn, the trapped air creating an air gap between the staple fibers, resulting in an expansion of the staple fibers, the twisting of the single strand of staple fibers in the first direction is for a predefined number of twists, and the twisting of the single strand of staple fibers in the second direction is for a predefined number of twists, the predefined number of twists in the second direction being same as the predefined number of twists in the first direction.

2. The process of claim 1, wherein the twisting of the single strand of staple fibers in the first direction is based on a twist per meter.

3. The process of claim 2, wherein the twisting of the single strand of staple fibers in the second direction is based on a twist per meter, the twist per meter in the second direction being the same as the twist per meter of the first direction.

4. The process of claim 1, wherein the twisting of the single strand of staple fibers in the first direction is in a 'S' direction or 'Z' direction.

5. The process of claim 1, wherein the twisting of the single strand of staple fibers in the second direction is in a direction opposite to the twisting of the single strand of staple fibers in the first direction.

6. A process for manufacturing a single yarn, comprising:

twisting a single strand of staple fibers in a first direction; and twisting the single strand of staple fibers in a second direction, wherein a change of twisting from the first direction to the second direction or vice versa inducing a false twist so that staple fibers are viewed in a single twist direction, the change of twisting traps air within or between the staple fibers in the single yarn, the trapped air creating an air gap between the staple fibers, resulting in an expansion of the staple fibers, the twisting of the single strand of staple fibers in the first direction is based on a twist per meter, and the twisting of the single strand of staple fibers in the second direction is based on a twist per meter, the twist per meter in the second direction being the same as the twist per meter of the first direction.

* * * * *